US009176460B2

(12) United States Patent
Takenoshita et al.

(10) Patent No.: US 9,176,460 B2
(45) Date of Patent: Nov. 3, 2015

(54) IMAGE FORMING APPARATUS PROVIDED WITH LIQUID RETAINER FOR RETAINING AND DRAINING LIQUID

(71) Applicant: Brother Kogyo Kabushiki Kaisha, Nagoya-shi, Aichi-ken (JP)

(72) Inventors: Yuji Takenoshita, Nagoya (JP); Takashi Hoshino, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/538,304

(22) Filed: Nov. 11, 2014

(65) Prior Publication Data

US 2015/0139686 A1 May 21, 2015

(30) Foreign Application Priority Data

Nov. 15, 2013 (JP) ..... 2013-237169

(51) Int. Cl.
*G03G 15/00* (2006.01)
*G03G 21/16* (2006.01)

(52) U.S. Cl.
CPC ..... *G03G 21/1619* (2013.01); *G03G 21/1623* (2013.01); *G03G 21/1633* (2013.01)

(58) Field of Classification Search
CPC ..... G03G 21/1633; G03G 2221/1687; G03G 2221/169; G03G 21/1619
USPC ..... 399/107, 111, 124
See application file for complete search history.

(56) References Cited

U.S. PATENT DOCUMENTS

| | | | | |
|---|---|---|---|---|
| 7,484,722 | B2 | 2/2009 | Ishii | |
| 7,748,706 | B2 | 7/2010 | Ishii | |
| 7,995,948 | B2 * | 8/2011 | Yano et al. | 399/107 |
| 8,155,556 | B2 | 4/2012 | Moribe et al. | |
| 8,204,401 | B2 * | 6/2012 | Tsuchiya | 399/107 |
| 2006/0008294 | A1 | 1/2006 | Ito et al. | |
| 2006/0269320 | A1 | 11/2006 | Ishii | |
| 2007/0002290 | A1 | 1/2007 | Muraki et al. | |

(Continued)

FOREIGN PATENT DOCUMENTS

| | | | |
|---|---|---|---|
| JP | H03-217861 | A | 9/1991 |
| JP | 2002-137493 | A | 5/2002 |

(Continued)

OTHER PUBLICATIONS

May 22, 2015—(US) Notice of Allowance—U.S. Appl. No. 14/547,608.

(Continued)

*Primary Examiner* — Robert Beatty
(74) *Attorney, Agent, or Firm* — Banner & Witcoff, Ltd.

(57) ABSTRACT

An image forming apparatus includes: a casing including a base frame, a top cover, and an access cover; a grooved portion; and a cartridge. The top cover is provided at the base frame and has a first edge. The access cover is provided at the base frame and pivotally movable between an open position and a closed position. The access cover has an upper region providing a second edge. The second edge is positioned along the first edge when the access cover is at the closed position. The upper region of the access cover at the closed position and the top cover defines a boundary therebetween. The grooved portion has a groove positioned below the first edge and a second edge. The cartridge is attached to and detached from the casing and positioned below the boundary and the grooved portion.

22 Claims, 9 Drawing Sheets

(56) References Cited

U.S. PATENT DOCUMENTS

| | | | |
|---|---|---|---|
| 2007/0036604 | A1 | 2/2007 | Maekawa et al. |
| 2008/0049260 | A1 | 2/2008 | Moribe et al. |
| 2009/0116889 | A1 | 5/2009 | Ishii |
| 2013/0272744 | A1 | 10/2013 | Wakayama et al. |

FOREIGN PATENT DOCUMENTS

| | | | | |
|---|---|---|---|---|
| JP | 2002137493 | A | * | 5/2002 |
| JP | 2002-182441 | A | | 6/2002 |
| JP | 2002-351282 | A | | 12/2002 |
| JP | 2005018011 | A | * | 1/2005 |
| JP | 2006-053508 | A | | 2/2006 |
| JP | 2006-337570 | A | | 12/2006 |
| JP | 2007-062159 | A | | 3/2007 |
| JP | 2007292968 | A | * | 11/2007 |
| JP | 2008-052037 | A | | 3/2008 |
| JP | 2009-169126 | A | | 7/2009 |
| JP | 2009169120 | A | * | 7/2009 |
| JP | 4826387 | B2 | | 11/2011 |
| JP | 2012-203989 | A | | 10/2012 |
| JP | 2012203989 | A | * | 10/2012 |

OTHER PUBLICATIONS

Jun. 11, 2015—(US) Notice of Allowance—U.S. Appl. No. 14/525,608.

Jun. 23, 2015—(US) Notice of Allowance—U.S. Appl. No. 14/553,116.

* cited by examiner

IMAGE FORMING APPARATUS PROVIDED WITH LIQUID RETAINER FOR RETAINING AND DRAINING LIQUID

CROSS REFERENCE TO RELATED APPLICATION

This application claims priority from Japanese Patent Application No. 2013-237169 filed Nov. 15, 2013. The entire content of the priority application is incorporated herein by reference.

TECHNICAL FIELD

The present invention relates to an image forming apparatus provided with a cover that opens and closes an opening formed in a casing.

BACKGROUND

There is conventionally known an image forming apparatus including a pivotally movable cover provided at a front portion of a casing. By closing the cover, an edge of the cover is aligned with an edge of a top cover of the casing.

SUMMARY

According to the above-described image forming apparatus, it is conceivable that a gap is provided at a boundary between the edge of the cover and the edge of the top cover. Therefore, liquid such as water may be entered into an internal space of the casing, if liquid is splashed onto the boundary.

In view of the foregoing, it is an object of the present invention to provide an image forming apparatus capable of avoiding entry of liquid into an internal space of a casing.

In order to attain the above and other objects, the present invention provides an image forming apparatus that may include: a casing; a grooved portion; and a cartridge. The casing may provide an opening and include: a base frame; a top cover; and an access cover. The top cover may be provided at the base frame and have a first edge. The top cover may provide a top surface of the casing. The access cover may be provided at the base frame and configured to pivotally move relative to the base frame between an open position for opening the opening and a closed position for covering the opening. The access cover may have an upper region providing a second edge and a part of the top surface of the casing. The second edge may be positioned along the first edge when the access cover is at the closed position. The upper region of the access cover at the closed position and the top cover may define a boundary therebetween. The grooved portion may have a groove positioned below the first edge and a second edge. The cartridge may be configured to be attached to and detached from the casing through the opening. The cartridge may be positioned below the boundary and the grooved portion.

DETAILED DESCRIPTION

Figure 1:
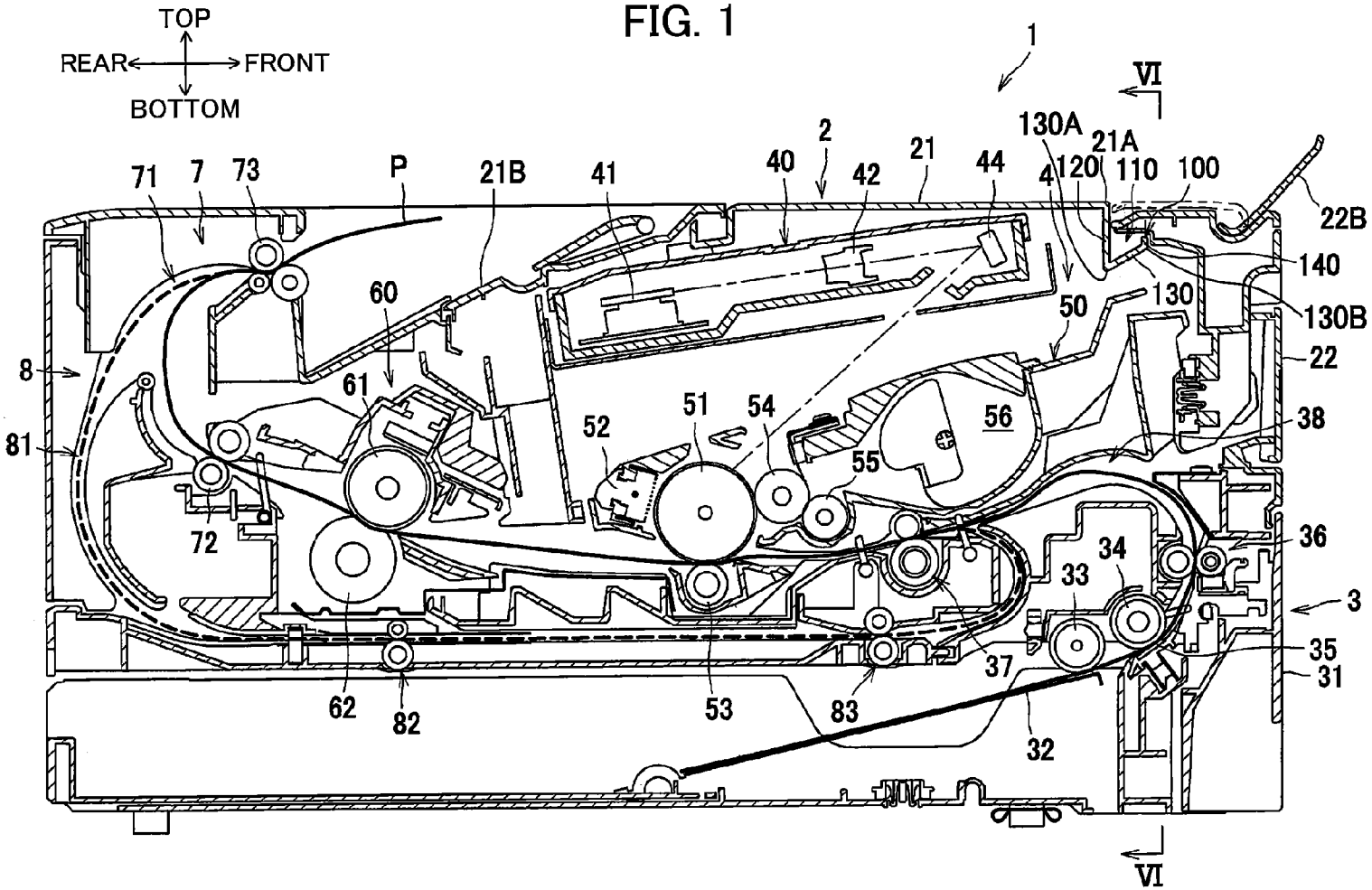
FIG. 1 is a cross-sectional view of a laser printer according to one embodiment of the present invention.

A laser printer 1 as an image forming apparatus according to one embodiment of the present invention will be described with reference to FIGS. 1 through 8, wherein like parts and components are designated by the same reference numerals to avoid duplicating description.

In the following description, the terms "upward", "downward", "upper", "lower", "above", "below", "beneath", "right", "left", "front", "rear" and the like will be used assuming that the laser printer 1 is disposed in an orientation in which it is intended to be used. In use, the laser printer 1 is disposed as illustrated in FIG. 1 in which a right side and a left side in FIG. 1 correspond to a front side and a rear side of the laser printer 1, respectively. Further, a top side and a bottom side in FIG. 1 correspond to a top side and a bottom side of the laser printer 1, respectively. Still further, a near side and a far side in FIG. 1 correspond to a left side and a right side of the laser printer 1.

<Overall Structure of Laser Printer>

The laser printer 1 is configured to perform image formation on both sides of a sheet P. As illustrated in FIG. 1, the laser printer 1 includes a casing 2 in which a sheet supply portion 3, an image forming portion 4, a sheet discharge portion 7, and a sheet turnover portion 8 are positioned.

Figure 2:
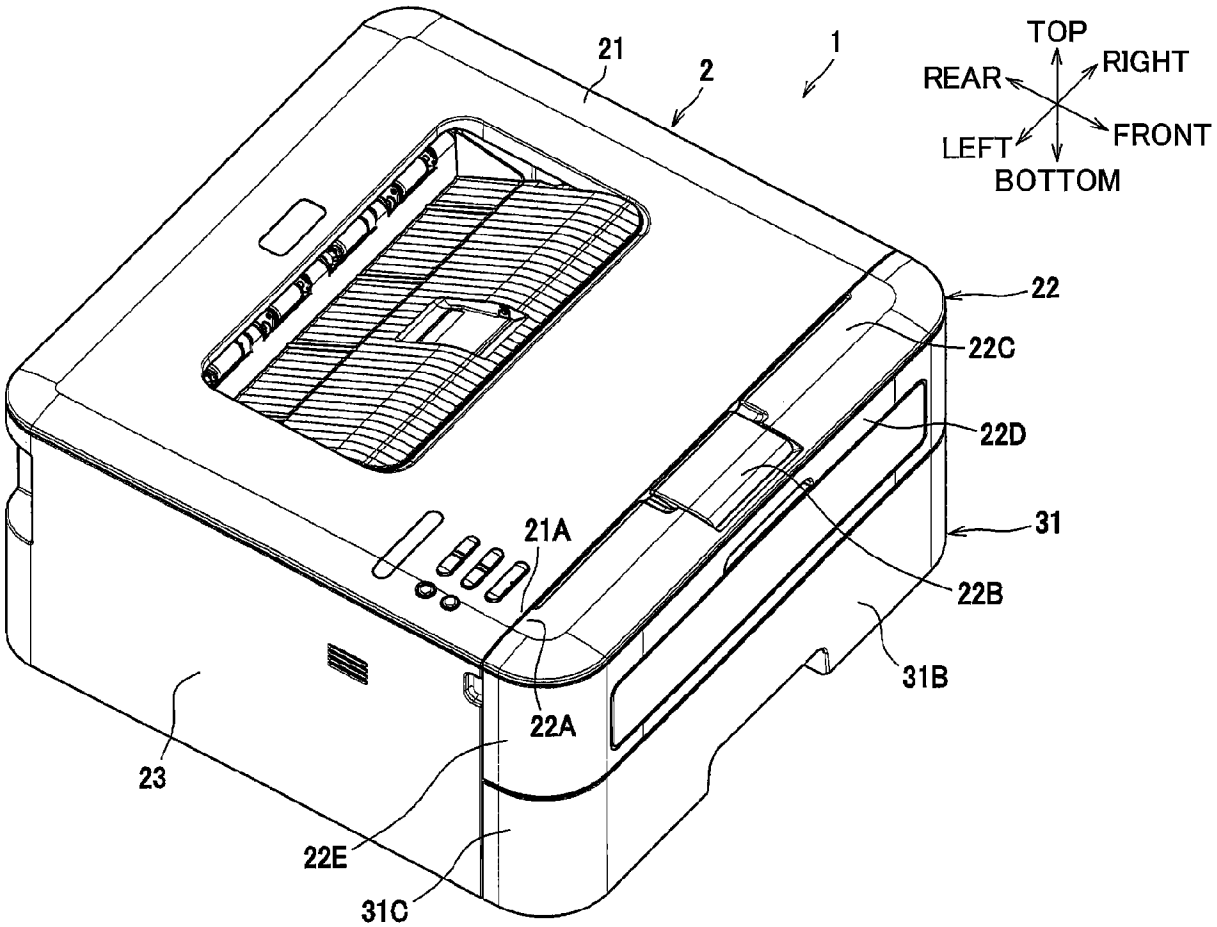
FIG. 2 is a perspective view of the laser printer as viewed from above, showing a state where a front cover is closed.
Figure 3:
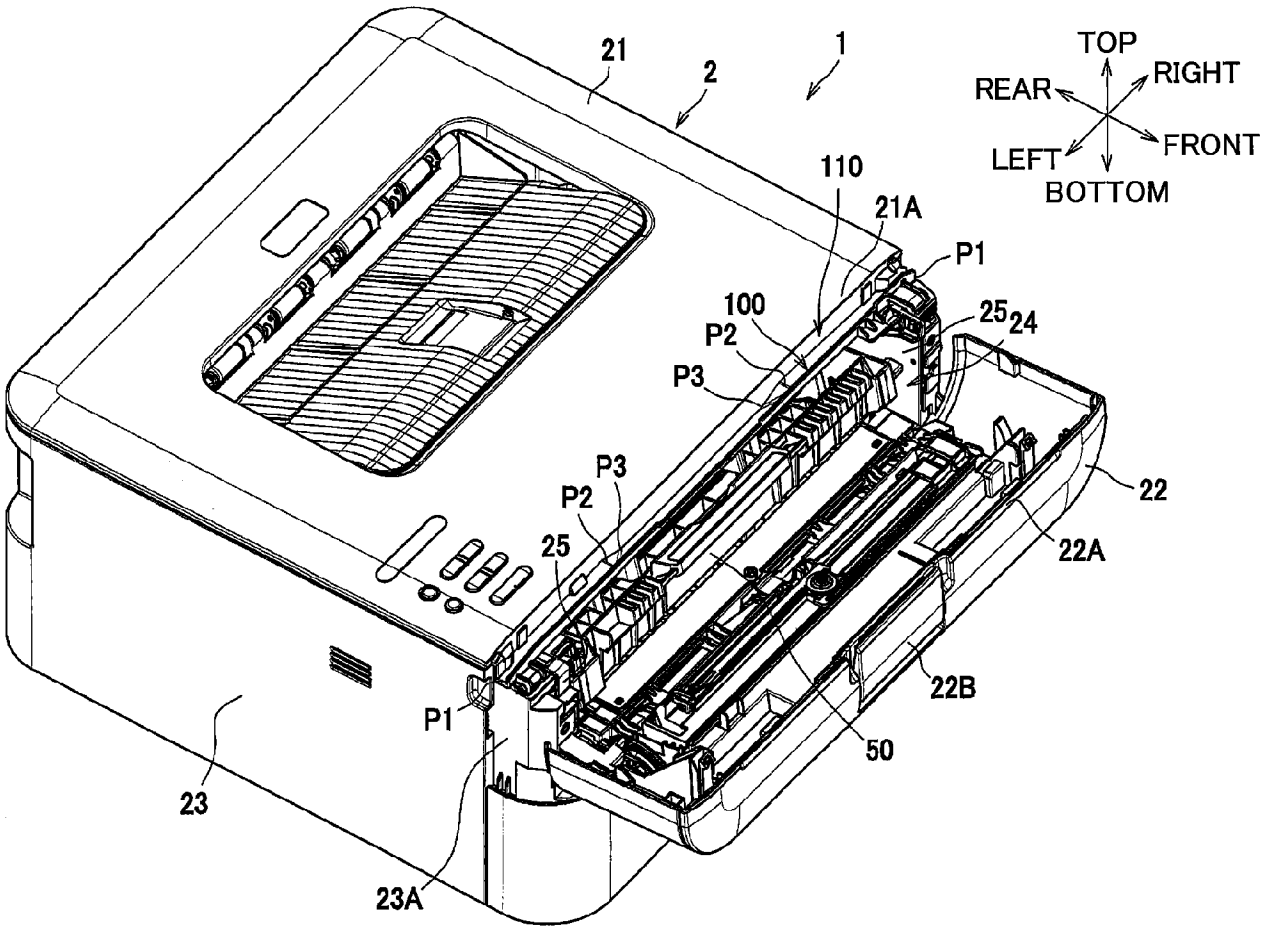
FIG. 3 is a perspective view of the laser printer as viewed from above, showing a state where the front cover is open.

As illustrated in FIGS. 2 and 3, the casing 2 includes a top cover 21, a front cover 22 as an example of an access cover, a pair of side covers 23 as an example of a base frame, and a support frame 25. An opening 24 opening frontward is provided at a front end of the casing 2.

The top cover 21 constitutes an upper side of the casing 2, and provides a top surface of the casing 2. The top cover 21 has a front edge 21A as an example of a first edge extending in a leftward/rightward direction or a lateral direction. A discharge tray 21B is provided at the top cover 21. As illustrated in FIG. 3, a liquid retaining member 100 is provided integrally with the front edge 21A. The liquid retaining member 100 is an example of a grooved portion.

The front cover 22 constitutes a front side of the casing 2, and is connected to the support frame 25 so as to be pivotally movable about a pivot axis between an open position (FIG. 3) and a closed position (FIG. 2). Thus, the opening 24 can be opened or covered by the front cover 22. The pivot axis of the front cover 22 extends in the leftward/rightward direction (as an example of an axial direction).

As illustrated in FIG. 2, the front cover 22 includes an upper region 22C, a front region 22D, and a pair of side regions 22E. The upper region 22C constitutes a part of the top surface of the casing 2 at a front side thereof when the front cover 22 is closed. The front region 22D constitutes a part of a front surface of the casing 2 at an upper side thereof when the front cover 22 is closed. Each of the side regions 22E constitutes a part of a side surface of the casing 2 at a front upper side thereof when the front cover 22 is closed.

Figure 6:
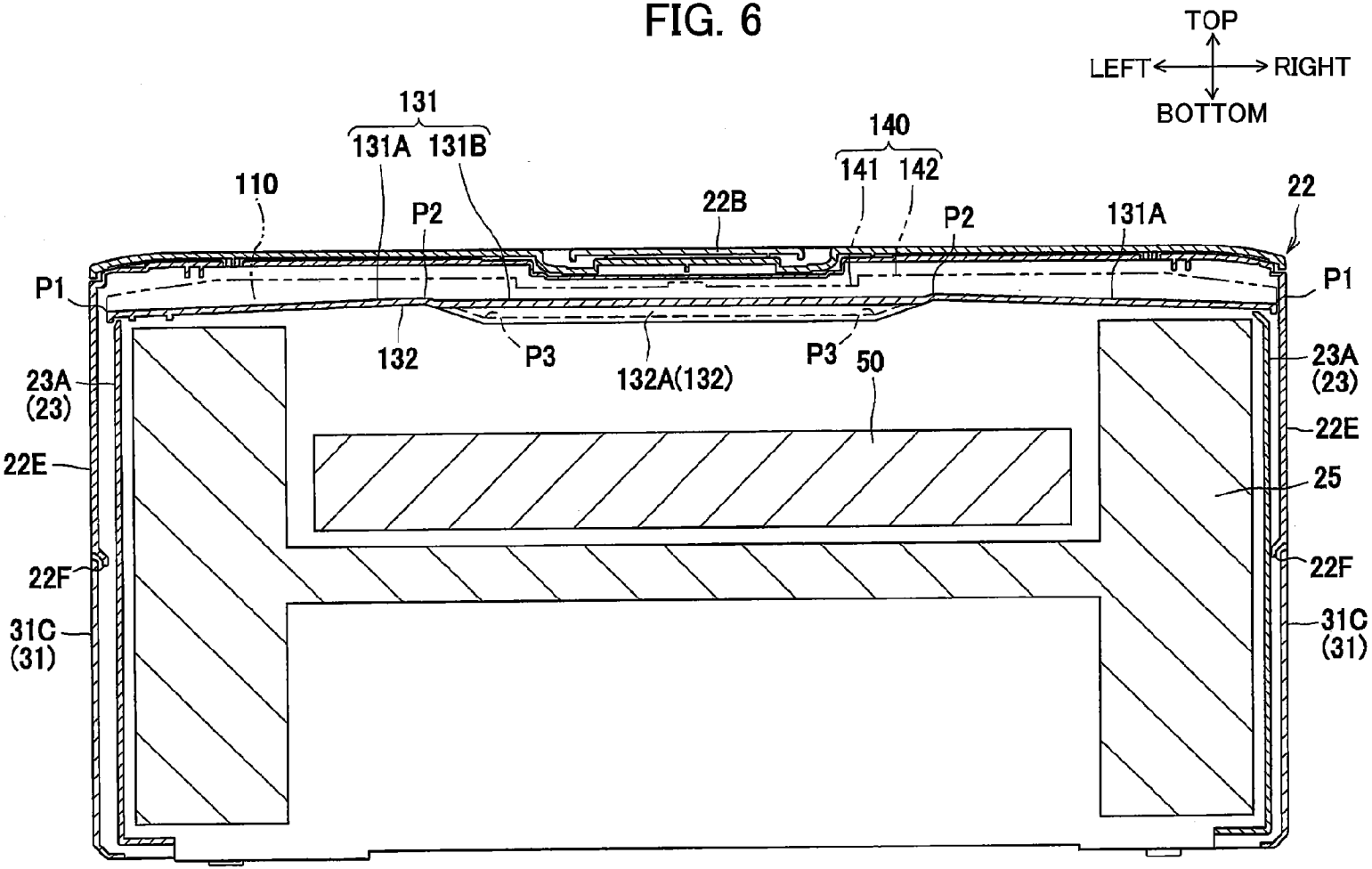
FIG. 6 is a cross-sectional view of the laser printer taken along a line VI-VI in FIG. 1 with simplifying an internal configuration of the laser printer.

The upper region 22C has a rear edge 22A as an example of a second edge extending in the leftward/rightward direction. The rear edge 22A is positioned along the front edge 21A of the top cover 21 when the front cover 22 is at its closed position. Each side region 22E has a lower end portion 22F positioned laterally inwardly in comparison with a remaining portion of the side region 22E as illustrated in FIG. 6. With this structure, the lower end portions 22F of the side regions 22E can be positioned inward of a sheet supply tray 31 (described later) at the closed position of the front cover 22.

The front cover 22 pivotally movably supports an extension tray 22B at a laterally center portion of the top surface of the casing 2 (see also FIG. 1). The extension tray 22B is extendible from and retracted into the upper region 22C such that an upper surface of the extension tray 22B is flush with an upper surface of the upper region 22C when the extension tray 22B is at the retracted position.

Each of the side covers 23 provides a side surface of the casing 2. As illustrated in FIG. 3 (only left side cover 23 is illustrated), each side cover 23 has a front end portion 23A positioned laterally inward of a remaining portion of the side cover 23. With this structure, the front end portion 23A can be covered by corresponding one of the pair of side regions 22E of the front cover 22 and corresponding one of a pair of side regions 31C (described later) of the sheet supply tray 31 as illustrated in FIGS. 2 and 4, when the front cover 22 is at its closed position.

Figure 4:
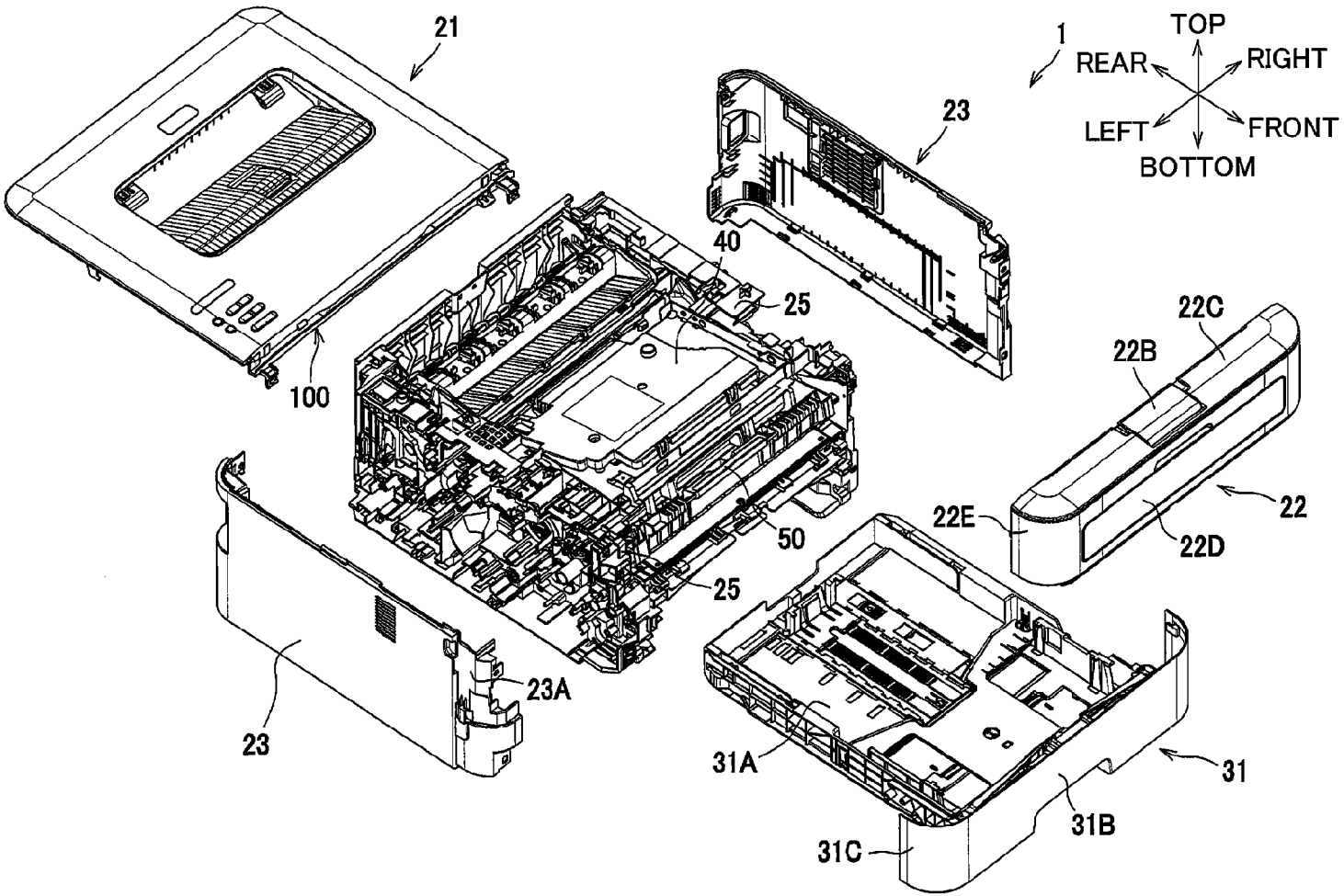
FIG. 4 is an exploded perspective view of the laser printer.

As illustrated in FIGS. 3 and 4, the support frame 25 is configured to support the image forming portion 4 including an exposure unit 40 and a process cartridge 50 (both described later). The support frame 25 is covered with the side covers 23.

As illustrated in FIG. 1, the sheet supply portion 3 is configured to supply the sheet P to the image forming portion 4. The sheet supply portion 3 is positioned at a lower internal portion of the casing 2. The sheet supply portion 3 includes the sheet supply tray 31, a lifter plate 32, a pick-up roller 33, a separation roller 34, a separation pad 35, a pair of feed rollers 36, a pair of registration rollers 37 and a sheet feed passage 38.

As illustrated in FIG. 4, the sheet supply tray 31 has a sheet mount portion 31A, a front region 31B, and the pair of side regions 31C. The front region 31B and the side regions 31C are positioned frontward of the sheet mount portion 31A.

The front region 31B of the sheet supply tray 31 is positioned below the front region 22D of the front cover 22 to form a part of the front surface of the casing 2 at a lower portion thereof. Each of the side regions 31C of the sheet supply tray 31 is positioned below corresponding one of the side regions 22E of the front cover 22 to form a part of the side surface of the casing 2 at a front lower portion thereof. Each side region 31C covers a lower portion of the front end portion 23A of the corresponding side cover 23.

As illustrated in FIG. 1, the sheet P mounted on the sheet supply tray 31 is urged toward the pick-up roller 33 by the lifter plate 32, and is delivered to the sheet feed passage 38 by the pick-up roller 33. One sheet P is separated from remaining sheet(s) P at the separation roller 34 and the separation pad 35, and is fed by the feed rollers 36. Diagonal feeding of the sheet P is corrected by the pair of registration rollers 37, and the sheet P is conveyed toward the image forming portion 4.

The image forming portion 4 is configured to form an image on the supplied sheet P. The image forming portion 4 is positioned above the sheet supply tray 31. The image forming portion 4 includes the exposure unit 40, the process cartridge 50 as an example of a cartridge, and a fixing unit 60.

The exposure unit 40 is positioned at an upper internal portion of the casing 2. The exposure unit 40 includes a laser emitting portion (not illustrated), a rotationally driven polygon mirror 41, a lens 42, and a reflection mirror 44. As indicated by one dotted chain line, a laser beam based on image data is emitted from the laser emitting portion and scanned at a high speed on an outer peripheral surface of a photosensitive drum 51 by way of the polygon mirror 41, the lens 42 and the reflection mirror 44 in this order.

The process cartridge 50 is positioned below the exposure unit 40. The process cartridge 50 is configured to be attached to and detached from the casing 2 through the opening 24 when the front cover 22 is at the open position (see FIG. 3). The process cartridge 50 includes the photosensitive drum 51, a charger 52, a transfer roller 53, a developing roller 54, a supply roller 55, and a toner accommodation portion 56 for accommodating a toner. The process cartridge 50 has a front end positioned below a boundary between the upper region 22C of the front cover 22 and the top cover 21.

The fixing unit 60 is positioned rearward of the process cartridge 50. The fixing unit 60 includes a heat roller 61 and a pressure roller 62 positioned in confrontation with and in pressure contact with the heat roller 61.

In the image forming portion 4, an electrostatic latent image corresponding to the image data is formed on the outer peripheral surface of the photosensitive drum 51 upon exposure to high speed laser beam scanning from the exposure unit 40, after the outer peripheral surface is uniformly charged by the charger 52. Toner in the toner accommodation portion 56 is supplied to the developing roller 54 through the supply roller 55, and is then carried on the surface of the developing roller 54.

The toner carried on the developing roller 54 is then supplied to the electrostatic latent image formed on the photosensitive drum 51. Thus, a visible toner image corresponding to the electrostatic latent image is formed on the photosensitive drum 51. Then, the toner image carried on the photosensitive drum 51 is transferred onto the sheet P supplied from the sheet supply portion 3 when the sheet P passes between the photosensitive drum 51 and the transfer roller 53. The toner image transferred onto the sheet P is thermally fixed to the sheet P when the sheet P passes through the fixing unit 60.

The sheet discharge portion 7 is configured to discharge the sheet P on which the image has been thermally fixed to an outside of the casing 2. The sheet discharge portion 7 includes a discharge passage 71, a pair of conveyor rollers 72, and discharge rollers 73.

The discharge passage 71 is configured to guide the sheet P. The discharge passage 71 is curved to deliver the sheet P from the fixing unit 60 to the discharge tray 21B by the conveyor rollers 72 and the discharge rollers 73.

The discharge rollers 73 are provided at a position adjacent to an exit of the discharge passage 71. The discharge rollers 73 are rotatable in a normal direction and a reversal direction by a conventional controller. More specifically, the sheet P is delivered to an outside of the casing 2 by the normal rotation of the discharge rollers 73, while the sheet P is delivered to the sheet turnover portion 8 by the reversal rotation of the discharge rollers 73.

In the sheet discharge portion 7, the image carrying sheet P discharged from the image forming portion 4 is fed diagonally rearward and upward, and is then turned frontward toward the discharge rollers 73 as indicated by a solid line in FIG. 1. The sheet P is then discharged onto the discharge tray 21B when image formation on the sheet P subjected to single-side printing or double-side printing is completed. Incidentally, the extension tray 22B frontwardly protruding out of the front cover 22 is also a part of the discharge tray 21B.

In case of double-side printing, the sheet P already subjected to one-side printing is fed toward the outside of the casing 2 by the normal rotation of the discharge rollers 73. Then, the discharge rollers 73 are rotated in the reversal direction before the sheet P in its entirety is discharged outside of the casing 2. Thus, the sheet P can be fed into the interior of the casing 2 and is conveyed into the sheet turnover portion 8 as indicated by a broken line in FIG. 1.

The sheet turnover portion 8 is configured to deliver the sheet P already subjected to one-side printing for performing printing to another side of the sheet P at the image forming portion 4. The sheet turnover portion 8 includes a re-conveyance passage 81, and two pairs of re-conveyance rollers 82, 83.

The re-conveyance passage 81 is configured to convey the sheet P already subjected to one-side printing toward the sheet feed passage 38 by the reversal rotation of the discharge rollers 73. More specifically, the re-conveyance passage 81 is branched from the discharge passage 71 at a position adjacent to its rear end, and extends downward and then is curved frontward at a position above the sheet supply tray 31 and approaches the pair of re-conveyance rollers 83 through the pair of re-conveyance rollers 82. The re-conveyance passage 81 then passes through the pair of re-conveyance rollers 83 and is then curved upward and then rearward to merges with the sheet feed passage 38.

In the sheet turnover portion 8, the sheet P is fed along the re-conveyance passage 81 as indicated by the broken line in FIG. 1 by the reversal rotation of the discharge rollers 73, and is again delivered to the image forming portion 4 through the sheet feed passage 38 for performing printing on the other side of the sheet P. After an image has been formed on the other side of the sheet P, the sheet P is discharged onto the discharge tray 21B by the sheet discharge portion 7 as indicated by the solid line in FIG. 1.

<Liquid Retaining Member>

Next, the liquid retaining member 100 will be described.

As illustrated in FIGS. 3 and 4, the liquid retaining member 100 is integral with the top cover 21. The liquid retaining member 100 provides a groove 110 at a position immediately below the boundary between the top cover 21 and the front cover 22.

Figure 5:
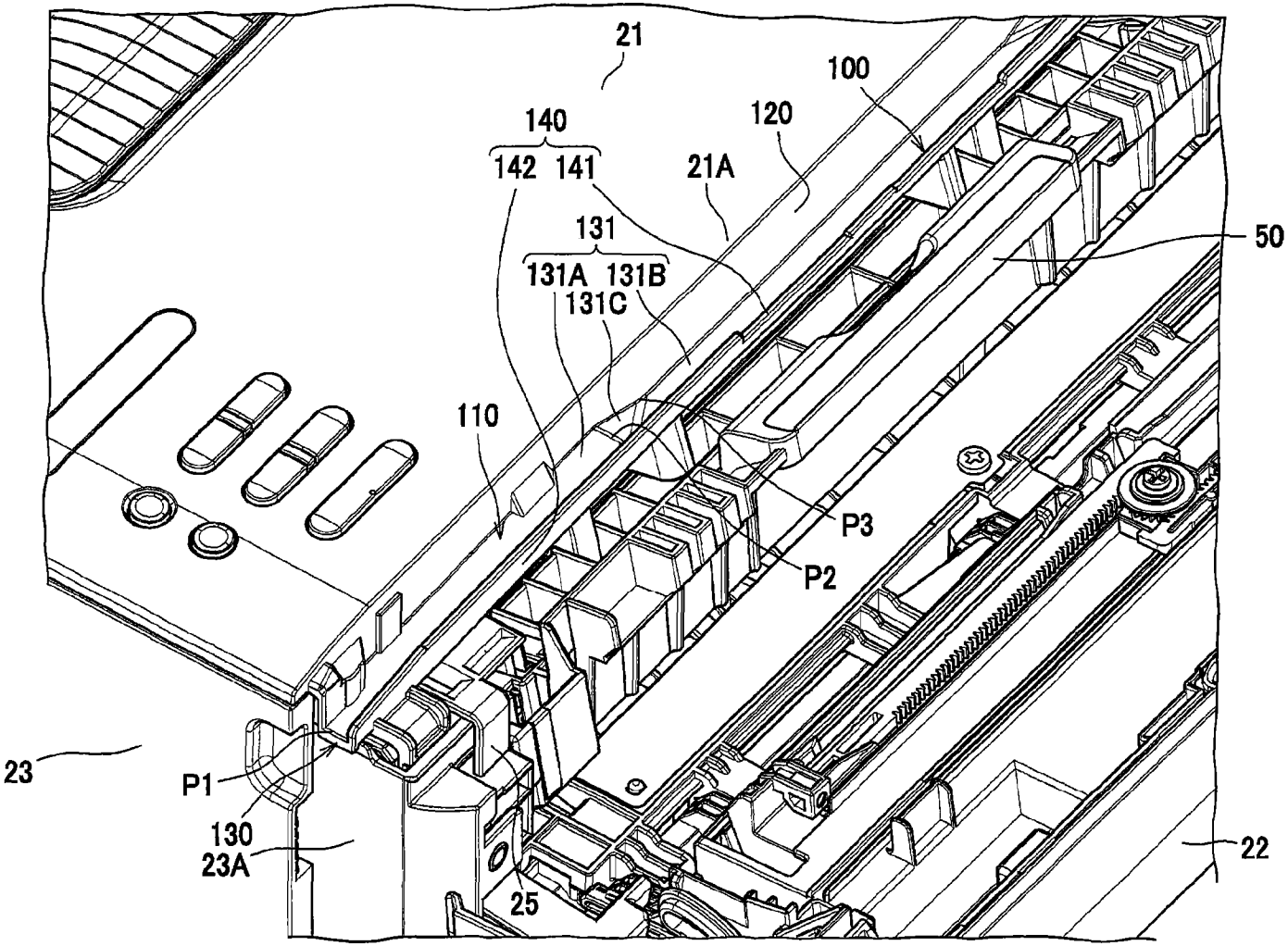
FIG. 5 is a partial enlarged perspective view of the laser printer, particularly showing a groove in FIG. 3.

As illustrated in FIGS. 5 and 6, the groove 110 extends in the lateral direction (the axial direction of the pivot axis of the front cover 22). More specifically, the groove 110 extends from a position inward of the support frames 25 to a position outward of the support frame 25 in the lateral direction. In other words, the groove 110 extends to laterally outer sides of the front end portions 23A of the side covers 23. The groove 110 has an outermost end P1 (as an example of an axial end) positioned outward of the front end portion 23A of the side cover 23 in the lateral direction as illustrated in FIG. 6.

The groove 110 is provided by a third wall 120, a first wall 130 and a second wall 140.

The third wall 120 constitutes a rear side wall for the groove 110, and extends downward from the front edge 21A of the top cover 21. The third wall 120 has a front surface 120A.

The first wall 130 constitutes a bottom wall for the groove 110, and extends frontward from a lower edge of the third wall 120. The first wall 130 has a first end 130A (see FIGS. 1 and 8) close to the top cover 21 and a second end 130B (see FIGS. 1 and 8) close to the front cover 22. As illustrated in FIG. 6, the first wall 130 has an upper surface 131 constituting a bottom surface of the groove 110, and a lower surface 132 opposite to the upper surface 131.

As illustrated in FIGS. 5 and 6, the upper surface 131 includes a pair of first inclined surfaces 131A, a second inclined surface 131B (see also FIG. 7), and a pair of fourth inclined surfaces 131C. Each first inclined surface 131A is positioned at a laterally end portion of the upper surface 131 of the first wall 130 and offset from the extension tray 22B in the lateral direction. The second inclined surface 131B is positioned at a laterally intermediate portion of the upper surface 131 of the first wall 130 and at a position corresponding to the extension tray 22B. Each fourth inclined surface 131C is positioned between one of the first inclined surfaces 131A and the second inclined surface 131B.

Incidentally, "the position corresponding to the extension tray 22B" implies a position superposed with the extension tray 22B as viewed in a vertical direction, and a position adjacent to the superposed position in the lateral direction. Further, the "position corresponding to the extension tray 22B" is also referred to as a "position in alignment with the extension tray 22B".

As illustrated in FIGS. 5 and 6, the first inclined surface 131A has an inner end P2 which is a boundary between the first inclined surface 131A and the fourth inclined surface 131C, and the first inclined surface 131A is inclined downward with distance from the inner end P2 toward the outermost end P1. With this structure, liquid entered into the groove 110 can flow along the first inclined surface 131A toward the outermost end P1 and can be discharged outside of the groove 110 at the outermost end P1.

Figure 7:
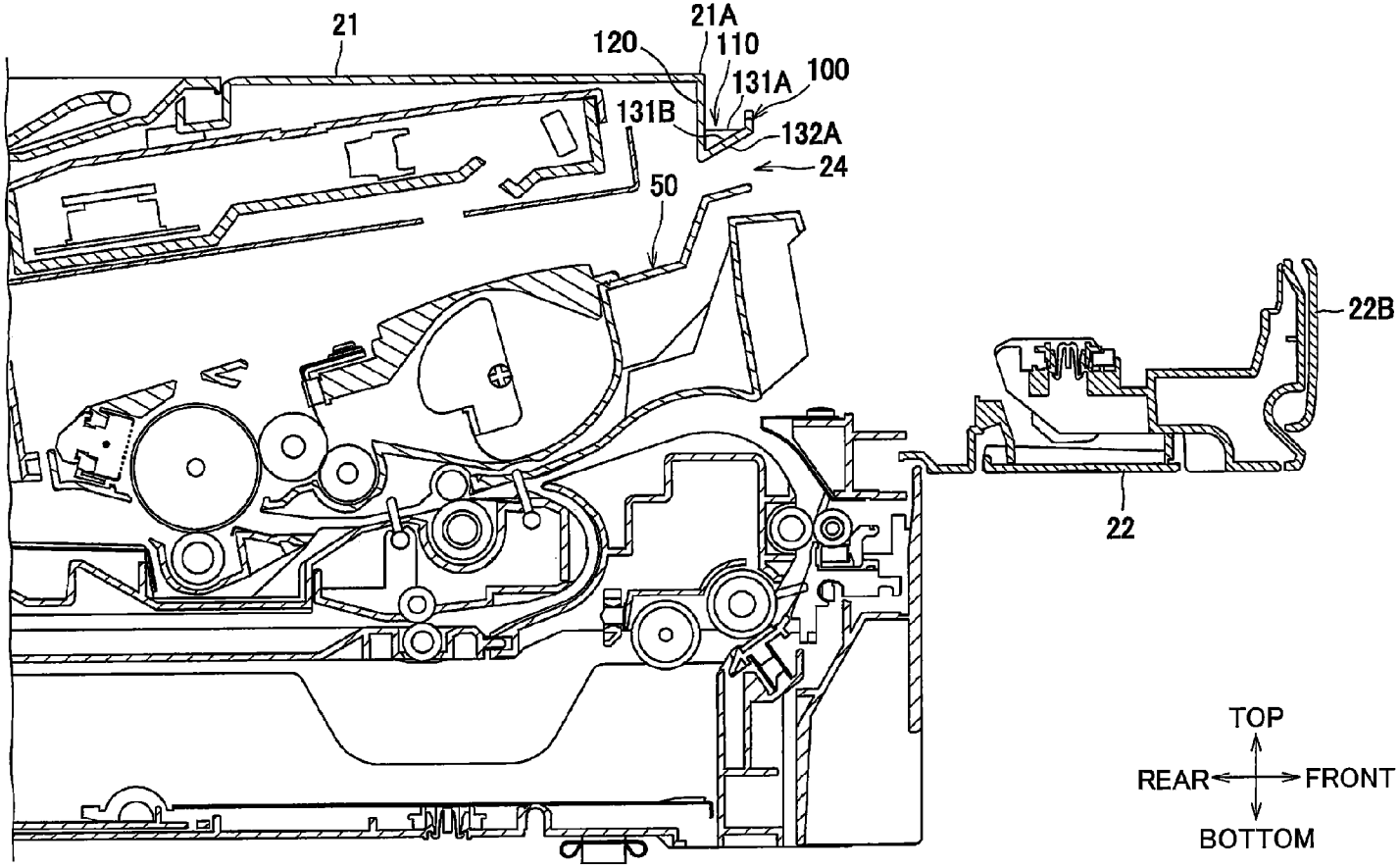
FIG. 7 is a partial cross-sectional view of the laser printer, showing the state where the front cover is open.
Figure 8:
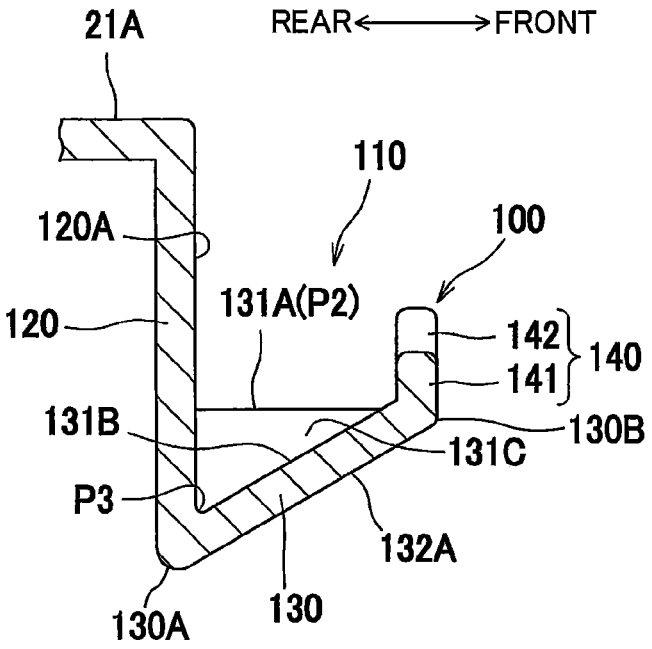
FIG. 8 is an enlarged cross-sectional view of the groove in FIG. 7.

As illustrated in FIGS. 6, 7 and 8, the second inclined surface 131B is positioned inward of the inner end P2 in the lateral direction, and is inclined upward with distance from the third wall 120 in a frontward/rearward direction.

As illustrated in FIG. 8, the fourth inclined surface 131C connects the first inclined surface 131A and the second inclined surface 131B, and provides a triangular surface defined by the front surface 120A of the third wall 120, the first inclined surface 131A, and the second inclined surface 131B. The fourth inclined surface 131C is inclined upward in a laterally outward direction toward the first inclined surface 131A with distance from an apex P3 of the fourth inclined surface 131C. The apex P3 is located at a lowermost point of the second inclined surface 131B.

With this structure, the lowermost end, i.e. the apex P3, of the fourth inclined surface 131C is positioned lower than the inner end P2 of the first inclined surface 131A. In other words, the first wall 130 is provided such that a portion of the first wall 130 at the position corresponding to the extension tray 22B is recessed downward than a remaining portion of the first wall 130, that is, a portion of the first wall 130 at the position offset from the extension tray 22B. More specifically, the first wall 130 is recessed at the fourth inclined surfaces 131C such that the second inclined surface 131B is positioned lower than the first inclined surfaces 131A.

The lower surface 132 of the first wall 130 has a third inclined surface 132A positioned opposite to the second inclined surface 131B. Similar to the second inclined surface 131B, the third inclined surface 132A is inclined upward with distance from the third wall 120 in the frontward/rearward direction. With this structure, as illustrated in FIG. 7, the opening 24 at the third inclined surface 132A has a cross-sectional area gradually increased with distance from the third wall 120 in the frontward/rearward direction.

As illustrated in FIG. 5, the second wall 140 constitutes a front side wall for the groove 110, and extends upward from a front edge of the first wall 130. As illustrated in FIGS. 5 and 6, the second wall 140 includes a center wall portion 141 as an example of a first upper edge region and outer wall portions 142 as an example of a second upper edge region in the lateral direction. The position of the center wall portion 141 is located at the position corresponding to the extension tray 22B. Each outer wall portion 142 is positioned outward of the center wall portion 141 and offset from the extension tray 22B in the lateral direction. In other words, each outer wall portion 142 is positioned outward of the extension tray 22B in the lateral direction and does not overlap the extension tray 22B as viewed in the vertical direction.

The center wall portion 141 has an upper edge lower than an upper edge of the outer wall portion 142. That is, the second wall 140 is provided such that a portion of the second wall 140 at the position corresponding to the extension tray 22B is lower than a remaining portion of the second wall 140, that is, a portion of the third wall portion 140 at the position offset from the extension tray 22B. Thus, the portion of the second wall 140 at the position corresponding to the extension tray 22B is recessed downward, so that the extension tray 22B can be placed at the recessed portion.

The center wall portion 141 is provided at a position laterally inward of the second inclined surface 131B. More specifically, the center wall portion 141 is positioned laterally inward of the apexes P3. Because the second inclined surface 131B is provided at a position corresponding to the center wall portion 141, the groove 110 at or around the center wall portion 141 can have a sufficient depth.

Further, the upper edge of the center wall portion 141 is higher than the inner end P2 whose position is the highest in the upper surface 131 of the first wall 130, i.e., the bottom surface of the groove 110. This structure can prevent liquid accumulated on the second inclined surface 131B from overflowing from the center wall portion 141 because the liquid can flow toward the first inclined surfaces 131A.

Liquid drainage function in the laser printer 1 will next be described.

As illustrated in FIG. 2, at the closed position of the front cover 22, the front edge 21A of the top cover 21 and the rear edge 22A of the upper region 22C of the front cover 22 are positioned face to face. In other words, the front edge 21A is positioned along the rear edge 22A at the closed position of the front cover 22.

Here, liquid may be entered into the interior of the casing 2 through the boundary between the top cover 21 and the front cover 22, if liquid is splashed onto the top surface of the casing 2. However, according to the embodiment, the entered liquid can be trapped in the groove 110 of the liquid retaining member 100 because the groove 110 is positioned below the boundary as illustrated in FIG. 5. Consequently, even by liquid penetration through the boundary, intrusion of liquid onto parts and components in the internal space of the casing 2 can be restrained.

Further, as illustrated in FIG. 6, liquid trapped in the groove 110 can flow laterally outward along the first inclined surfaces 131A, and is discharged out of the side covers 23. Then, the discharged liquid passes through a space between each side cover 23 and the corresponding side region 22E of the front cover 22 and between the side cover 23 and the corresponding side region 31C of the sheet supply tray 31 and is discharged to an outside of the casing 2. Thus, even by entry of liquid through the boundary between the top cover 21 and the front cover 22, the entered liquid can be discharged to the outside of the casing 2 by the liquid retaining member 100.

Further, the extension tray 22B can be rested in the downwardly recessed portion of the second wall 140. Therefore, the casing 2 can have a reduced height in spite of provision of the extension tray 22B at the front cover 22. Here, the center wall portion 141 of the second wall 140 is positioned lower than the remaining portion of the second wall 140, which may cause overflowing of liquid from the upper edge of the center wall portion 141 if liquid is entered and retained in a laterally intermediate portion of the groove 110. However, according to the embodiment, the laterally intermediate portion of the groove 110, that is, a portion of the groove 110 positioned at and around the center wall portion 141 has a sufficient depth, which causes less overflowing of liquid at the laterally intermediate portion of the groove 110.

Further, the first wall 130 has the downwardly recessed portion at the position corresponding to the extension tray 22B. Therefore, liquid is retained in the downwardly recessed portion of the first wall 130. However, such accumulated liquid does not overflow from the upper edge of the second wall 140, because the liquid can flow laterally outward along the first inclined surfaces 131A and be discharged to the outside of the casing 2 before overflowing Further, the front cover 22 must be opened for access to the process cartridge 50. Here, as illustrated in FIG. 7, provision of the liquid retaining member 100 may reduce an open area of the opening 24. However, according to the embodiment, the third inclined surface 132A is inclined such that the cross-sectional area of the opening 24 is gradually increased with distance from the third wall 120 in the frontward direction. This configuration is advantageous over a liquid retaining member whose bottom wall is not inclined for attachment and detachment of the process cartridge 50 relative to the casing 2.

Various modifications are conceivable.

Figure 9:
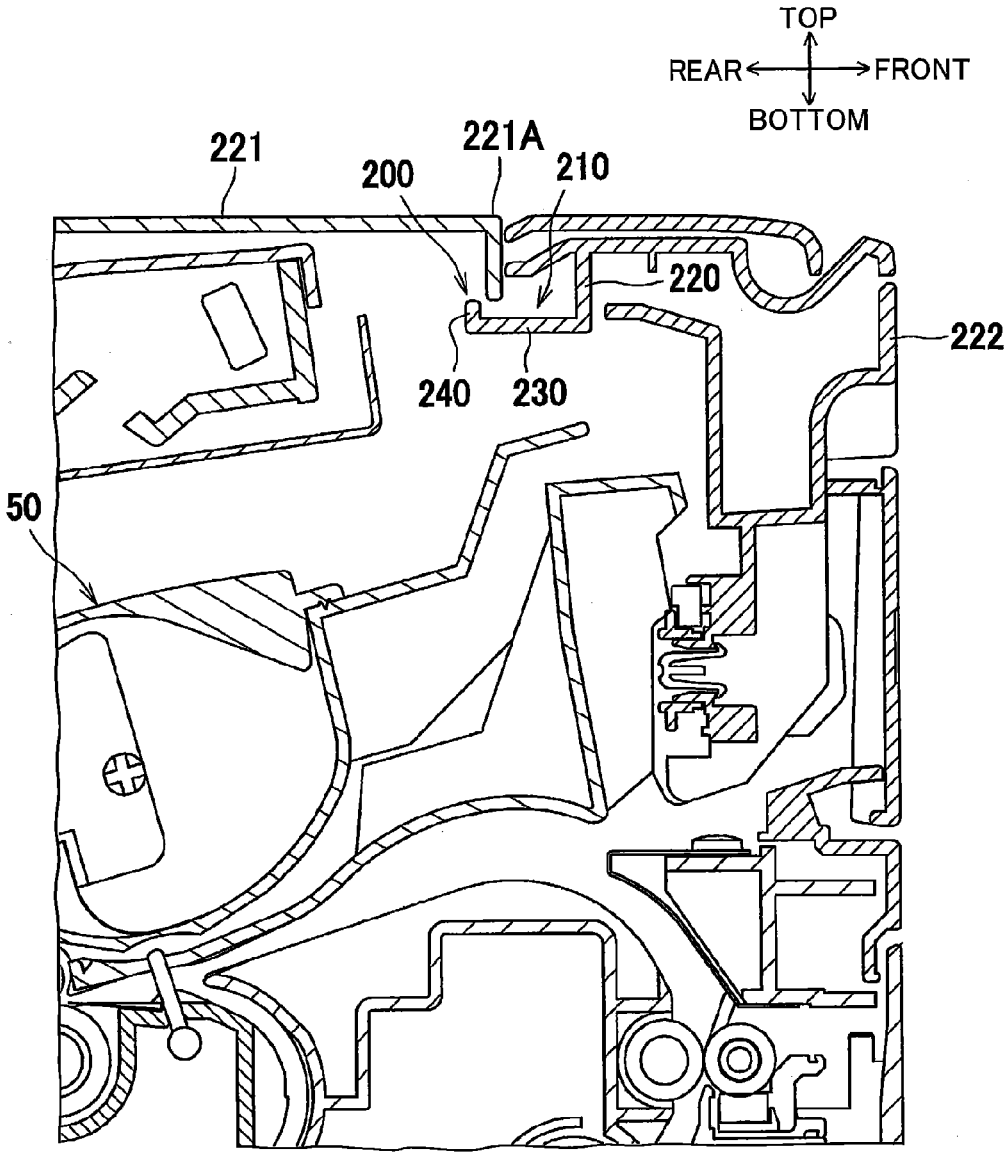
FIG. 9 is a partial enlarged cross-sectional view of a laser printer according to a modified embodiment of the present invention, particularly showing a liquid retaining portion.

FIG. 9 illustrates a modification to the above-described embodiment such that a liquid retaining member 200 is provided integral with a front cover 222. The liquid retaining member 200 has a groove 210 at a position below a boundary between a top cover 221 and the front cover 222. The liquid retaining member 200 includes a third wall 220, a first wall 230, and a second wall 240 for defining the groove 210.

The third wall 220 extends downward from a lower surface portion of the front cover 22 that is located frontward of and adjacent to a front edge 221A of the top cover 221. The first wall 230 extends rearward from a bottom end of the third wall 220. The second wall 230 extends upward from a rear end of the first wall 230. With this structure, the liquid retaining portion 200 can retain liquid therein leaked through the boundary between the top cover 221 and the front cover 222, thereby preventing internal components of the casing 2 from getting wet.

In the above-described embodiment, the liquid retaining member 100 is provided integrally with the top cover 21. However, the liquid retaining member 100 can be provided independent of the top cover 21 and the front cover 22.

Further, according to the above-described embodiment, the center wall portion 141 of the second wall 140 is lower than the outer wall portions 142 of the second wall 140. However, the center wall portion and the outer wall portions can have even height.

Further, according to the above-described embodiment, the first wall 130 has the laterally intermediate portion that is downwardly recessed. However, no recessed portion can be provided in the first wall 130 to provide a flat or continuous groove bottom.

Further, according to the above-described embodiment, the extension tray 22B is provided at the front cover 22. However, the extension tray 22B can be dispensed with.

Further, according to the above-described embodiment, the second inclined surface 131B and the third inclined surface 132A are provided at the position confronting to or corresponding to the extension tray 22B. However, these inclined surfaces can be provided along an entire length of the groove 110. Alternatively, these inclined surfaces can be dispensed with.

Further, according to the above-described embodiment, the groove 110 extends to the laterally outer sides of the front end portions 23A of the side covers 23. However, the groove 110 can extend such that each lateral end of the groove 110 can be on a thickness of the support frame 25 or on a thickness of the front end portion 23A.

Further, according to the above-described embodiment, the front cover 22 has the upper region 22C. However, the upper region 22C can be dispensed with.

Further, according to the above-described embodiment, the process cartridge 50 is an example of a cartridge. However, a developing cartridge and a toner cartridge attachable to and detachable from a process cartridge or drum cartridge can also be examples of the cartridge.

Further, according to the above-described embodiment, a monochromatic laser printer 1 is an example of an image forming apparatus. However, a color printer, a copying machine, and a multi-function device are also available as the image forming apparatus.

While the present invention has been described in detail with reference to the embodiment thereof, it would be apparent to those skilled in the art that various changes and modifications may be made therein without departing from the spirit of the present invention.

What is claimed is:

1. An image forming apparatus comprising:

an image forming portion:

a casing having an opening and comprising:

a base frame including a side cover, the side cover providing a side surface of the casing;

a top cover provided at the base frame and having a first edge extending in an extending direction, the top cover providing a top surface of the casing;

an access cover provided at the base frame and configured to pivotally move relative to the base frame between an open position for opening the opening and a closed position for covering the opening, the access cover having an upper region providing a second edge and a part of the top surface of the casing, the second edge being positioned along the first edge when the access cover is at the closed position, the upper region of the access cover at the closed position and the top cover defining a boundary therebetween, the access cover having a side region providing a part of the side surface of the casing; and a support frame configured to support the image forming portion the side cover being positioned outward of the support frame in the extending direction; and a grooved portion having a groove positioned below the first edge and the second edge, the groove being elongated in the extending direction to have an outermost end in the extending direction, the groove extending from a position inward of the support frame to a position outward of the support frame in the extending direction, the outermost end of the groove being positioned outward of the side cover in the extending direction, the side region covering the groove and a part of the side cover in the extending direction.

2. The image forming apparatus as claimed in claim 1, wherein the groove has a first inclined surface inclined downward toward the outermost end.

3. The image forming apparatus as claimed in claim 1, further comprising a sheet supply tray configured to be attached to and detached from the casing and positioned lower than the access cover, the sheet supply tray having a side region providing a part of the side surface of the casing, the side region of the sheet supply tray being positioned below the side region of the access cover and covering a part of the side cover in the extending direction.

4. The image forming apparatus as claimed in claim 2, wherein the grooved portion comprises a liquid retaining member having an upper surface facing upward to constitute a bottom surface of the groove, and a lower surface opposite to the upper surface, the upper surface having a second inclined surface inclined diagonally upward in a direction from the top cover to the access cover, the lower surface having a third inclined surface inclined diagonally upward in the direction from the top cover to the access cover.

5. The image forming apparatus as claimed in claim 1, further comprising an extension tray pivotally movably supported to the access cover, and wherein the grooved portion has a first wall providing a bottom of the groove, the first wall having a first end close to the top cover and a second end close to the access cover, the grooved portion also having a second wall extending upward from the second end, the second wall having a first upper edge region positioned in alignment with the extension tray, and a second upper edge region positioned offset from the extension tray, the first upper edge region being lower than the second upper edge region.

6. The image forming apparatus as claimed in claim 5, wherein the first wall has a downwardly recessed portion at a position in alignment with the extension tray.

7. The image forming apparatus as claimed in claim 1, wherein the grooved portion is provided at the top cover.

8. The image forming apparatus as claimed in claim 1, wherein the grooved portion is provided at the access cover.

9. The image forming apparatus as claimed in claim 1, wherein the groove is positioned immediately below the first edge and the second edge.

10. The image forming apparatus as claimed in claim 1, further comprising a cartridge configured to be attached to and detached from the casing through the opening, the cartridge being positioned below the boundary and the grooved portion.

11. An image forming apparatus comprising:

a casing having an opening and comprising:

a base frame;

a top cover provided at the base frame and having a first edge extending in an extending direction, the top cover providing a top surface of the casing; and an access cover provided at the base frame and configured to pivotally move relative to the base frame between an open position for opening the opening and a closed position for covering the opening, the access cover having an upper region providing a second edge and a part of the top surface of the casing, the second edge being positioned along the first edge when the access cover is at the closed position, the upper region of the access cover at the closed position and the top cover defining a boundary therebetween;

a grooved portion having a groove positioned below the first edge and the second edge, the groove being elongated in the extending direction to have an outermost end in the extending direction, the groove having a first inclined surface inclined downward toward the outermost end, the grooved portion including a liquid retaining member having an upper surface facing upward to constitute a bottom surface of the groove, and a lower surface opposite to the upper surface, the upper surface having a second inclined surface inclined diagonally upward in a direction from the top cover to the access cover, the lower surface having a third inclined surface inclined diagonally upward in the direction from the top cover to the access cover; and a cartridge configured to be attached to and detached from the casing through the opening, the cartridge being positioned below the boundary and the grooved portion.

12. The image forming apparatus as claimed in claim 11, further comprising an image forming portion, wherein the casing further comprises a support frame configured to support the image forming portion, and wherein the groove extends from a position inward of the support frame to a position outward of the support frame in the extending direction.

13. The image forming apparatus as claimed in claim 12, wherein the base frame comprises a side cover positioned outward of the support frame in the extending direction, the side cover providing a side surface of the casing, and wherein the outermost end of the groove is positioned outward of the side cover in the extending direction.

14. The image forming apparatus as claimed in claim 11, further comprising an extension tray pivotally movably supported to the access cover, wherein the grooved portion has a first wall providing a bottom of the groove, the first wall having a first end close to the top cover and a second end close to the access cover, the grooved portion also having a second wall extending upward from the second end, the second wall having a first upper edge region positioned in alignment with the extension tray, and a second upper edge region positioned offset from the extension tray, the first upper edge region being lower than the second upper edge region, and wherein the first wall has a downwardly recessed portion at a position in alignment with the extension tray.

15. An image forming apparatus comprising:

a casing having an opening and comprising:

a base frame;

a top cover provided at the base frame and having a first edge, the top cover providing a top surface of the casing; and an access cover provided at the base frame and configured to pivotally move relative to the base frame between an open position for opening the opening and a closed position for covering the opening, the access cover having an upper region providing a second edge and a part of the top surface of the casing, the second edge being positioned along the first edge when the access cover is at the closed position, the upper region of the access cover at the closed position and the top cover defining a boundary therebetween;

an extension tray pivotally movably supported to the access cover; and a grooved portion having a groove positioned below the first edge and the second edge, the grooved portion having a first wall providing a bottom of the groove, the first wall having a first end close to the top cover and a second end close to the access cover, the grooved portion also having a second wall extending upward from the second end, the second wall having a first upper edge region positioned in alignment with the extension tray, and a second upper edge region positioned offset from the extension tray, the first upper edge region being lower than the second upper edge region.

16. The image forming apparatus as claimed in claim 15, wherein the first edge extends in an extending direction, and wherein the groove is elongated in the extending direction to have an outermost end in the extending direction, and has a first inclined surface inclined downward toward the outermost end.

17. The image forming apparatus as claimed in claim 16, wherein the grooved portion comprises a liquid retaining member having an upper surface facing upward to constitute a bottom surface of the groove, and a lower surface opposite to the upper surface, the upper surface having a second inclined surface inclined diagonally upward in a direction from the top cover to the access cover, the lower surface having a third inclined surface inclined diagonally upward in the direction from the top cover to the access cover.

18. The image forming apparatus as claimed in claim 17, wherein the first upper edge region is positioned inward of the second inclined surface in the extending direction.

19. The image forming apparatus as claimed in claim 15, further comprising an image forming portion, wherein the casing further comprises a support frame configured to support the image forming portion, wherein the first edge extends in an extending direction, wherein the groove is elongated in the extending direction to have an outermost end in the extending direction, and wherein the groove extends from a position inward of the support frame to a position outward of the support frame in the extending direction.

20. The image forming apparatus as claimed in claim 19, wherein the base frame comprises a side cover positioned outward of the support frame in the extending direction, the side cover providing a side surface of the casing, and wherein the outermost end of the groove is positioned outward of the side cover in the extending direction.

21. The image forming apparatus as claimed in claim 15, wherein the first wall has a downwardly recessed portion at a position in alignment with the extension tray.

22. The image forming apparatus as claimed in claim 15, further comprising a cartridge configured to be attached to and detached from the casing through the opening, the cartridge being positioned below the boundary and the grooved portion.

* * * * *